United States Patent [19]

Weber

[11] 3,948,503

[45] Apr. 6, 1976

[54] CLAMP FOR FORMWORK SYSTEM

[75] Inventor: Adolph Carl Weber, Ballwin, Mo.

[73] Assignee: Midwestern Joists, Inc., Washington, Mo.

[22] Filed: Sept. 23, 1974

[21] Appl. No.: 508,545

[52] U.S. Cl. ..... 269/243; 29/559; 29/257; 248/235; 249/219 R; 269/321 S

[51] Int. Cl.[2] ..... B25B 1/10; B25B 5/10

[58] Field of Search ..... 29/559, 256, 257, 266; 269/243, 249, 292, 321 S; 249/219 R; 248/234, 235, 245

[56] References Cited

UNITED STATES PATENTS

| | | | |
|---|---|---|---|
| 950,494 | 3/1910 | Seidel | 248/234 |
| 1,570,407 | 1/1926 | Seidel | 248/234 |
| 1,763,677 | 6/1930 | Scott | 248/245 |
| 2,266,132 | 12/1941 | Tuisku | 29/257 X |
| 2,752,960 | 7/1956 | Poeltl | 269/243 X |
| 2,788,948 | 4/1957 | Pardee | 248/234 |
| 2,824,381 | 2/1958 | Traupmann | 269/249 X |
| 3,052,008 | 9/1962 | Bowden et al. | 248/245 X |
| 3,442,482 | 5/1969 | Preblich | 249/219 R |
| 3,472,475 | 10/1969 | Rudiger | 248/235 X |

*Primary Examiner*—Charlie T. Moon
*Attorney, Agent, or Firm*—Koenig, Senniger, Powers and Leavitt

[57] ABSTRACT

A system of and appurtenances for erecting formwork for pouring a slab in place on steel joists, wherein form supports are removably mounted extending transversely of the joists through the webs of the joists underneath the top chords of the joists, and forms are removably mounted on the supports.

2 Claims, 25 Drawing Figures

FIG. 3
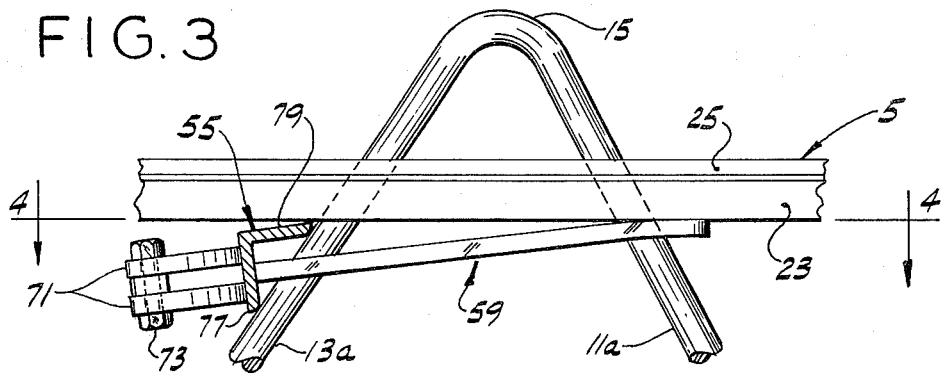
FIG. 4
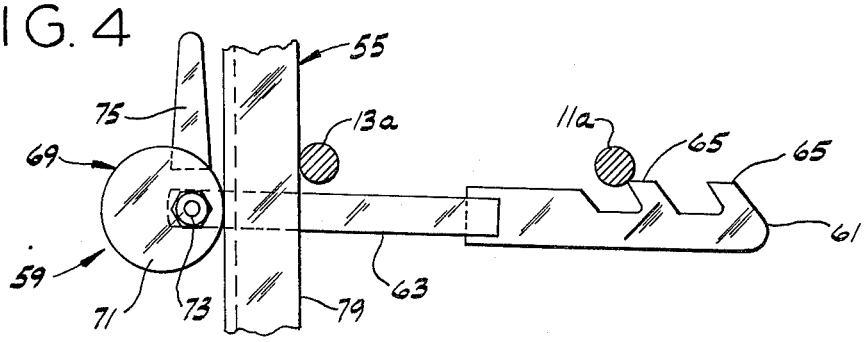
FIG. 5
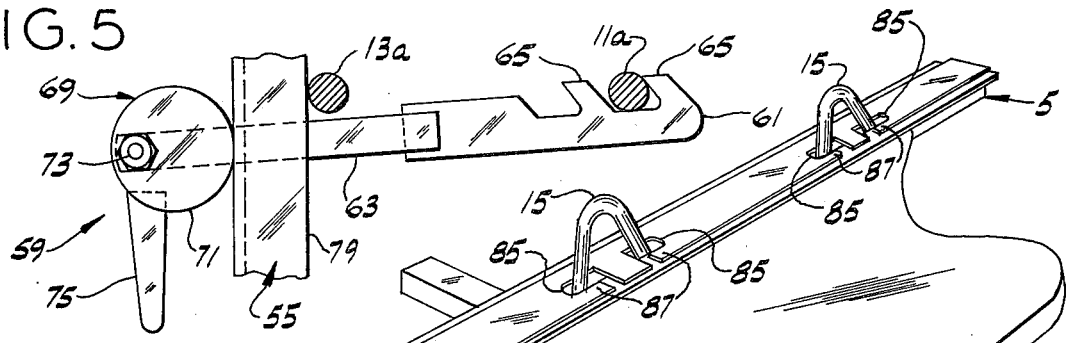
FIG. 6

CLAMP FOR FORMWORK SYSTEM

BACKGROUND OF THE INVENTION

This invention relates to a clamp for use in erecting formwork for pouring a slab in place on steel joists.

The invention is especially concerned with a clamp for use in erecting formwork for pouring a concrete slab in place on steel joists of the type in the form of a Warren truss, comprising a web and top and bottom chords. The web generally comprises a steel bar bent to zigzag form and each of the top and bottom chords comprises a pair of angle bars (or other suitable shapes) welded to opposite sides of the web. The joist may be a standard steel joist or a so-called composite joist in which the peaks of the web extend up above the top chord. Such a composite joist, wherein the chords are made of angle bars, may have its top chord angle bars either upright (i.e., with their horizontal legs at the top), or inverted as shown in U.S. Pat. No. 3,362,121. Heretofore it has been the usual practice to lay the formwork for the pouring of a concrete slab on the horizontal legs of the top chord angles, the formwork being constituted, for example, by corrugated steel plate or plywood, which remains in situ after the slab has been poured. With the cost of steel plate (or other in-place forms or centering) being what it is today, this practice is quite costly.

SUMMARY OF THE INVENTION

Among the several objects of this invention may be noted the provision of a clamp for use in a new method of erecting formwork for pouring a slab in place on steel joists which enables removal for re-use of the formwork, e.g., corrugated steel plate, wood boards, plywood or the like; and the provision a clamp for use in such a method which enables quick, economical installation and removal of the formwork.

In general, the clamp is used in a method comprising removably mounting form supports extending transversely of the joists through the webs of the joists underneath the top chords of the joists, and removably mounting on said form supports forms for the pouring of a slab with the forms extending underneath portions of the top chord bars.

Other objects and features will be in part apparent and in part pointed out hereinafter.

BRIEF DESCRIPTION OF THE DRAWINGS

FIG. 3 is a vertical section showing how a form support is removably clamped in place;

FIG. 4 is a horizontal section on line 4—4 of FIG. 3 showing how a clamp is initially applied;

FIG. 5 is a section similar to FIG. 4 showing the clamp drawn up;

FIG. 6 is a view similar to FIG. 1 showing a form in place and a closure strip applied to the top chord of the joist;

Corresponding reference characters indicate corresponding parts throughout the several views of the drawings.

DESCRIPTION OF THE PREFERRED EMBODIMENTS

Figure 1:
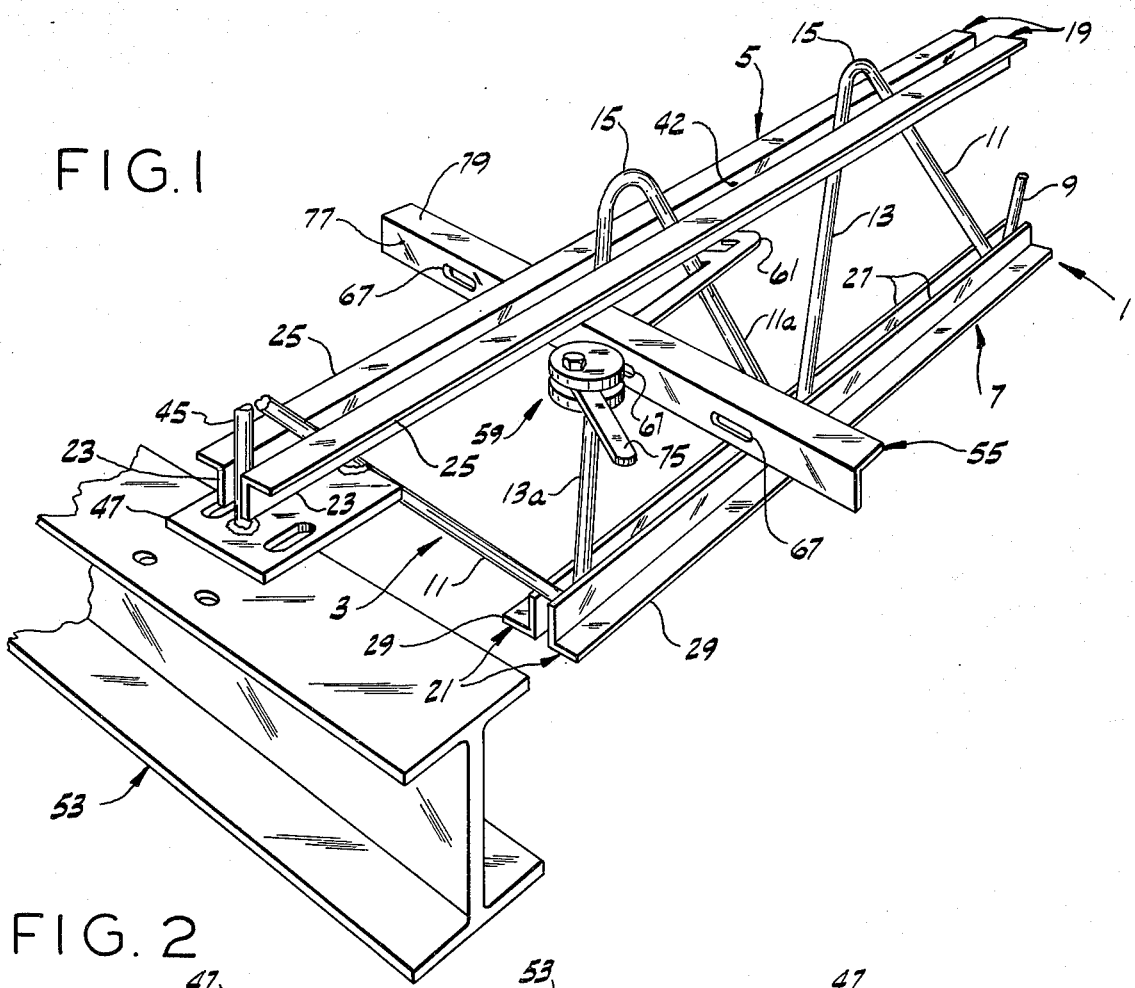
FIG. 1 is a perspective showing part of a joist and a form support removably mounted thereon.
Figure 2:
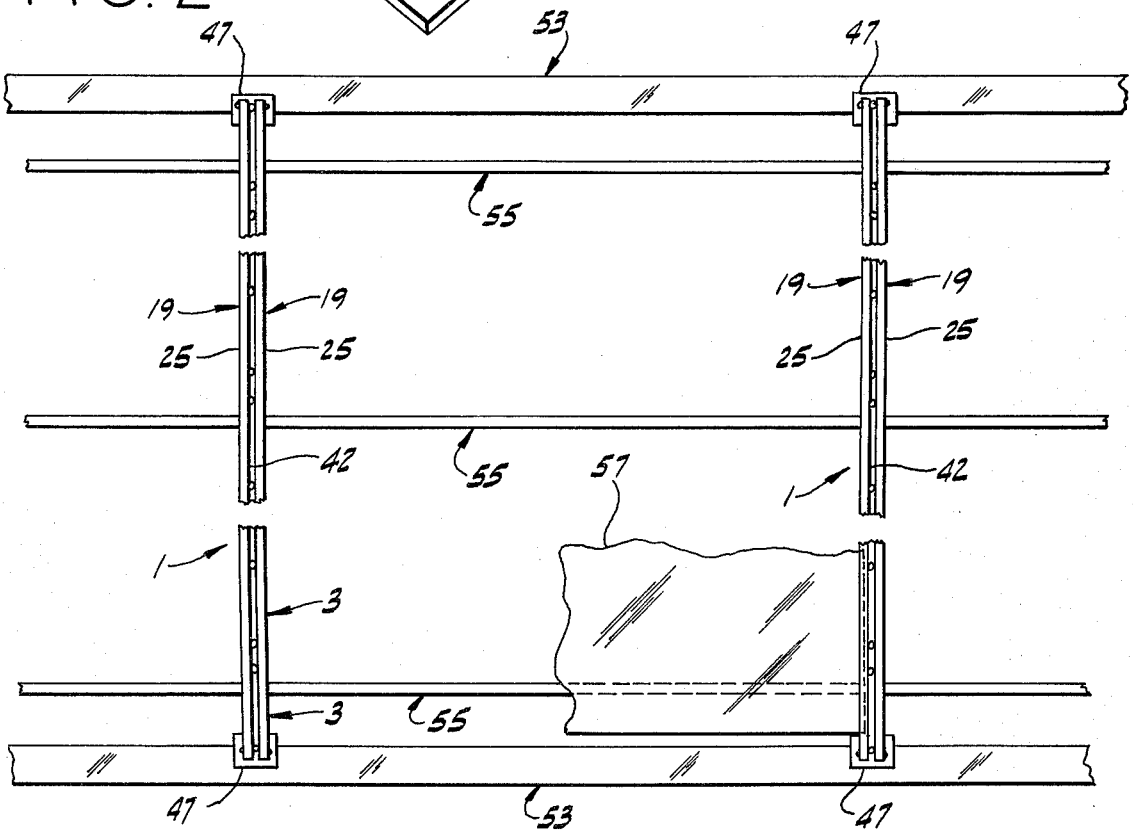
FIG. 2 is a plan showing two joists, a number of said form supports and a form removably supported thereby, the form being broken away.

Referring to the drawings, an open web steel joist in connection with which this invention is utilized is designated in its entirety by the reference numeral 1 (see FIGS. 1 and 2). As shown, the joist 1 is in the form of a truss, having a web generally designated 3, a top chord generally designated 5 and a bottom chord generally designated 7.

Figure 8:
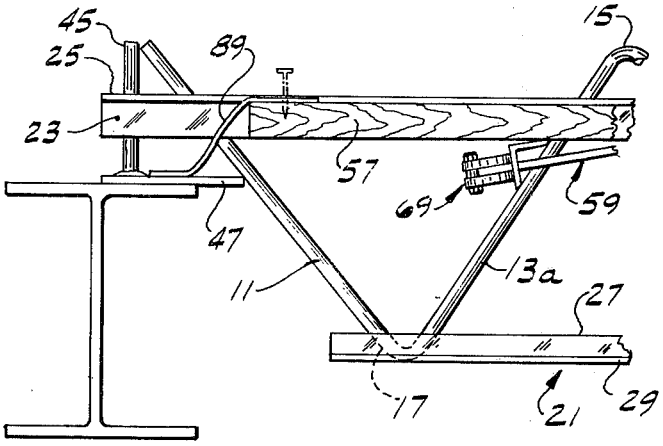
FIG. 8 is a vertical section showing how a gap between the form and a supporting beam may be closed.

The web 3 is an open web, principally comprising a steel bar 9, usually of solid circular cross section, which is bent into zigzag form with straight diagonals 11 and 13. Diagonals 11 are inclined at an angle in one direction and diagonals 13 are oppositely inclined so that the joist is in the form of a Warren truss, certain of the diagonals constituting compression members of the web, and certain of the diagonals constituting tension members of the web. Successive diagonals 11 and 13 are integrally joined at the top of the web at elbow-shaped peaks 15, and are integrally joined at the bottom of the web at lower elbows 17 (see FIGS. 8 and 9).

The top chord 5 comprises a pair of steel angle bars each designated 19 (see FIGS. 1 and 2). The bottom chord 7 comprises a pair of steel angle bars 21. The top chord angle bars 19 are longer than the bottom chord angle bars 21. The legs of each top chord angle bar 19, which are at right angles to one another, are designated 23 and 25. The legs of each bottom chord angle bar, which are at right angles to one another, are designated 27 and 29.

The top chord angle bars 19 are applied to the web 3 on opposite sides of the web adjacent the top of the web, with legs 23 of these bars positioned vertically and engaging opposite sides of the web, with legs 25 of bars 19 projecting horizontally laterally outward from the upper edges of legs 23 below the peaks 15 of the web. The peaks 15 of the web project upward beyond the upper horizontal legs 25 of the angle bars 19, presenting triangular loops of the web at 15 above said legs. The vertical legs 23 of the top chord angle bars are welded to the web 3.

The bottom chord angle bars 21 are applied to the web 3 on opposite sides of the web at the bottom of the web with legs 27 of these bars positioned vertically and engaging opposite sides of the web, and with legs 29 of these bars projecting horizontally laterally outward from the lower edges of legs 27. The lower elbows 17 of the web 3 lie wholly between legs 27 of bars 21, spaced somewhat above the bottom faces of legs 29 of these bars. Legs 27 are welded to web 3 in the same manner as legs 23 of the top chord angle bars 19 are welded to the web.

The chord angle bars 19 extend outward beyond the ends of the bottom chord angle bars 21 at each end of the joist. As shown, a short bar member 45 is provided extending vertically between the angle bars 19 of the top chord adjacent each end thereof, and a bearing plate 47 is provided on the bottom of each end of the top chord. As appears in FIG. 1, the extreme left-hand diagonal 11 provided by the zigzag bar 9 is a tension member, slanting up from the bottom chord toward the left end of the joist.

From the above, it will appear that the joist 1, as completed, is in the form of a truss having a web 3 comprising bar 9, a top chord 5 and a bottom chord 7. The web 3 is formed of metal (steel) bar stock comprising members 11, 13, triangulating the space between the top and bottom chords. The top chord comprises the pair of metal (steel) bars 19 each of angle shape in cross section having vertical leg 23 and horizontal leg 25, these bars 19 having their vertical legs 23 welded to opposite sides of the web adjacent but below the upper ends of the stated tension and compression members of the web. The vertical legs 23 are positioned with their upper edges below the upper ends of members 11, 13. The horizontal legs 25 of the top chord angle bars 19 project horizontally laterally outward from the upper edges of the vertical legs 23. The space between the vertical legs is indicated at 42.

FIGS. 1 and 2 show how the bearing plates 47 of the joist 1 are mounted on structural supports such as beams 53. In the construction of a floor (or roof) utilizing the joists 1, a plurality of the joists are placed in position spanning such supports therefor, the joists extending parallel to one another from support to support as illustrated in FIG. 2.

From supports indicated at 55 in FIGS. 1–6 are removably mounted in place extending transversely of the joists 1 through the open webs 3 of the joists underneath the top chords 5 of the joists, and forms 57 are removably mounted on the form supports 55 for the pouring of a slab with the forms extending underneath (as distinguished from extending over) the horizontal legs 25 of the top chord angle bars 19. As shown best in FIGS. 1, 3 and 6, the form supports 55 are constituted by angle bars mounted on certain of the inclined web members (e.g., 13*a* in FIGS. 1 and 2) of the joists and held up between these inclined web members and the bottom of the top chord 5 by means 59 for drawing the form supports (angle bars) up the stated inclined web members (e.g., 13*a*), said means extending between the form supports and each adjacent inclined web member (e.g., 11*a* in FIGS. 1 and 3).

As shown in FIGS. 1 and 3–5, means 59 is a cam clamp device comprising a hook member 61 having a shank 63 and a plurality of hooks 65 spaced along the length of the shank providing a plurality of hook lengths for the hook member. The shank 63, together with the hook member 61, is insertable through holes 67 in one of the legs of the angle bar form support 55 and has a cam clamp 69 constituted by a pair of disks 71 mounted for rotation at 73 at the end of the shank 63 opposite the hooks on an axis which is eccentric in relation to the disk centers, with a handle 75 secured to the disks for rotating them. The arrangement is such that with the shank 63 inserted through a hole 67 in angle bar 55, and with one of the hooks 65 hooked onto inclined member 11*a*, the cam clamp 69 may be rotated from its FIG. 4 to its FIG. 5 position to draw the angle bar 55 up the inclined member 13*a* and wedge it into engagement with the bottom of the top chord 5 (see FIGS. 1 and 3). The angle bar 55 is positioned with the edges of its two legs 77 and 79 engaging inclined member 13*a*. The holes 67 are in the downwardly extending leg 77 of angle bar 55.

With the form supports 55 installed as above described, forms such as indicated at 57 for the pouring of a slab are removably mounted on the form supports 55. As shown, the forms are plywood panels; they could be corrugated steel plate or the equivalent. The forms 57 are positioned to extend underneath the horizontal legs 25 of the top chord angle bars 19 as appears in FIGS. 6 and 8 so that they may be removed for re-use after the slab has been poured and set.

Figure 7:
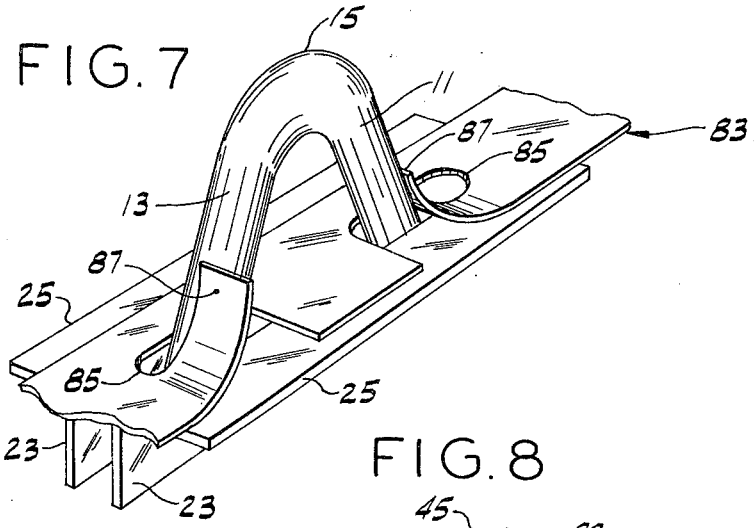
FIG. 7 is a perspective showing how the closure strip is applied.

At 83 in FIGS. 6 and 7 is indicated a closure strip or tape for the top chord 5 to prevent concrete from flowing down into space 42 between the vertical legs 23 of the top chord angle bars. This strip or tape, which may be made of building paper, for example, has a width somewhat less than the width of the top of the top chord 5 and is formed with L-shaped slots 85 for receiving the diagonals 11 and 13 at the level of the top of the top chord. These slots are arranged in pairs spaced at intervals corresponding to the spacing of diagonals 11 and 13 at the level of the top of the top chord. The strip 83 is applied laterally on top of the top chord by lifting the tongues 87 of the strip material bounding the slots, as shown in FIG. 7. Also, heavy building paper may be used as indicated at 89 in FIG. 8, to fill in the gaps between the forms 57 and the beams 53.

Figure 9:
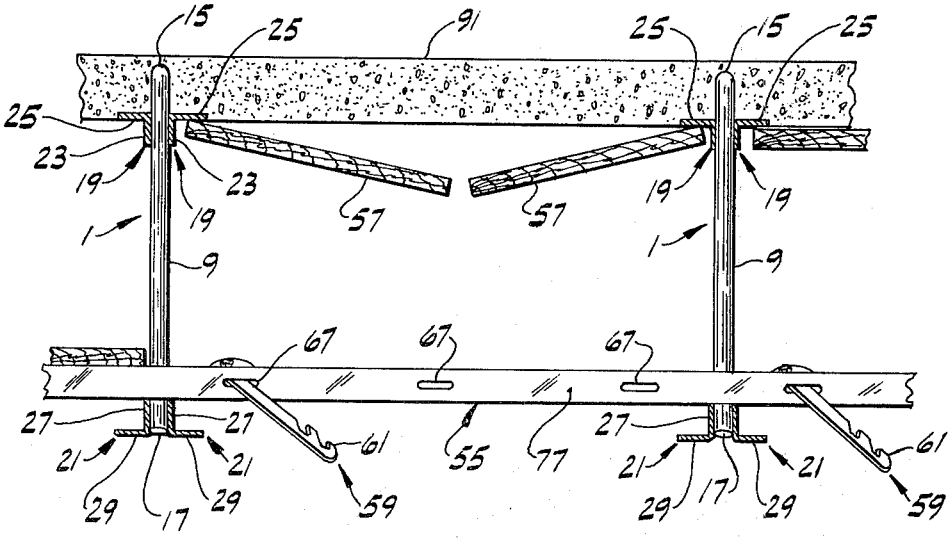
FIG. 9 is a vertical section showing a completed slab and the removal of the form supports and forms therefrom.

FIG. 9 shows the slab 91 which has been poured in place on the forms 57. As appears therein, the peaks 15 of the webs of the joists 1 and the upper legs 25 of the top chord angle bars 19 are embedded in the slab. FIG. 9 also shows how the forms 57 are removed by releasing the clamps 59, allowing the form supports 55 to drop down and be removed for re-use, and allowing the forms 57 to be tilted down from under the slab 91 and legs 25 of the top chord angle bars for easy removal.

Figure 10:
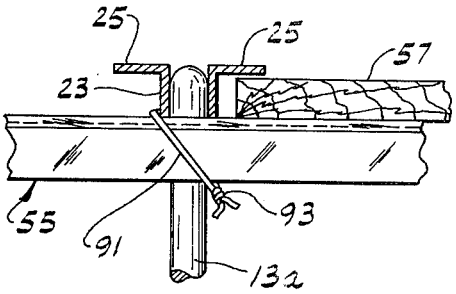
FIGS. 10 and 11 are views showing a second mode of holding the form supports.
Figure 11:
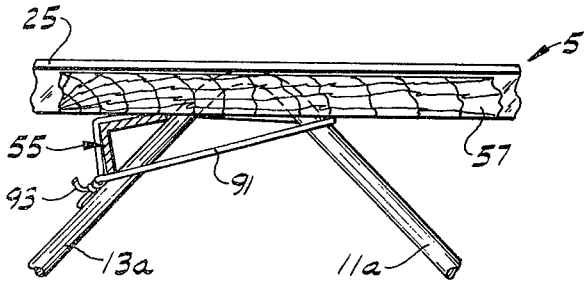

FIGS. 10 and 11 shows an alternative mode of holding a form support 55, involving utilization of a wire tie 91 which is looped around the inclined web member 11a and the form support 55 and twisted as indicated at 93 to draw the form support up the inclined web member 13*a* into engagement with the bottom of the top chord 5 of the joist. To remove the form support, the wire tie is cut. FIGS. 10 and 11 show a standard joist as distinguished from a composite joist.

Figure 12:
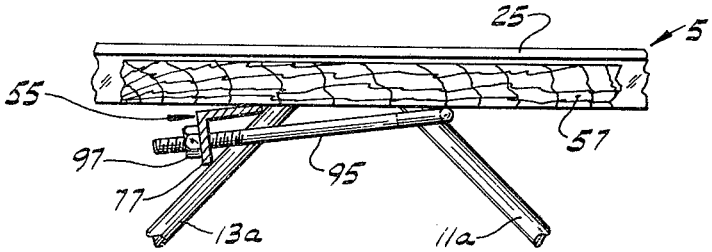
FIG. 12 is a view showing a third mode of holding the form supports.

FIG. 12 shows another mode of holding the form support 55, involving use of a hook bolt 95 which is hooked around the inclined web member 11*a*, which extends through a hole in the leg 77 of the form support, and which has a nut 97 threaded thereon to draw the form support up the inclinend web members 13*a* into engagement with the bottom of the top chord 5.

Figure 13:
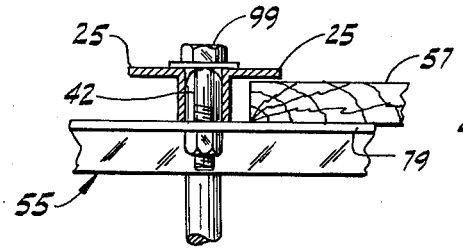
FIGS. 13 and 14 are views showing a fourth mode of holding the form supports.
Figure 14:
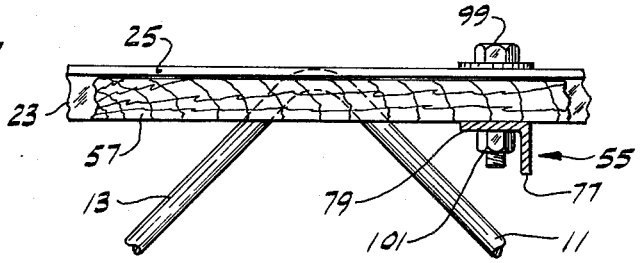
Figure 15:
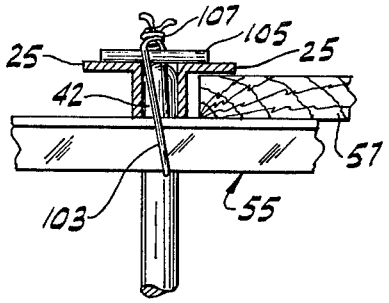
FIGS. 15 and 16 are views showing a fifth mode of holding the form supports.
Figure 16:
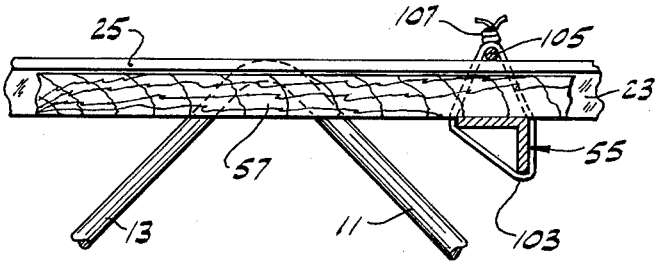
Figure 17:
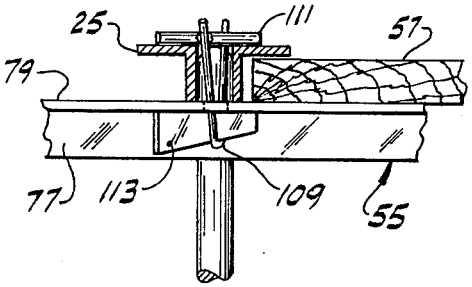
FIGS. 17 and 18 are views showing a sixth mode of holding the form supports.
Figure 18:
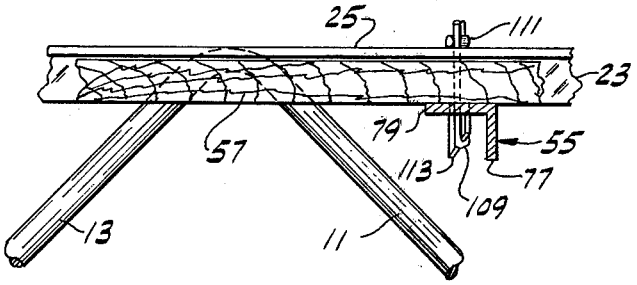
Figure 19:
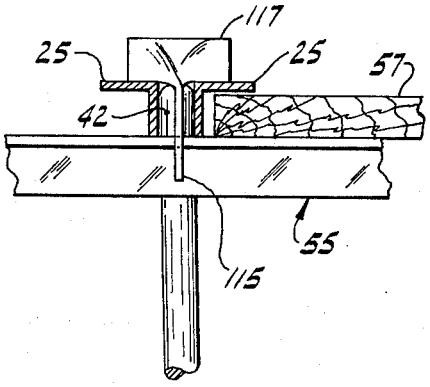
FIGS. 19 and 20 are views showing a seventh mode of holding the form supports.
Figure 20:
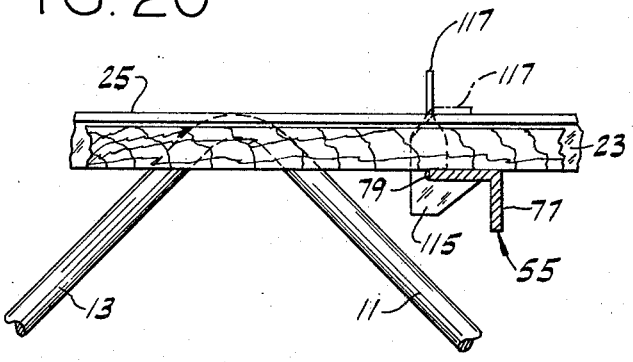

FIGS. 13–20 illustrate systems in which the form supports 55 are mounted in position extending transversely of the joists through the webs of the joists underneath the top chords 5 by inserting hangers for the form supports 55 through the spaces 42 between the top chord angle bars 19 of the joists. As shown in FIGS. 13 and 14, the hangers are threaded fasteners, e.g., bolts 99 extending down through the space 42 and through bolt holes in the horizontal flange 79 of support 55 with a nut 101 threaded up on the lower end of the bolt to draw the support 55 up against the bottom of the top chord angle bars. As shown in FIGS. 15 and 16, the hangers are wire ties 103, each looped around a support 55 and a pin 105 on top of the top chord and twisted as indicated at 107 to draw up the support 55. As shown in FIGS. 17 and 18, the hanger is a wire loop 109 welded to a cross pin 111 bearing on the top chord, the loop extending down through a hole in the horizontal leg 79 of the support 55, a wedge 113 being driven into the opening defined by the loop to draw up the support. FIGS. 19 and 20 show a hook 115 for holding up the support 55, this hook initially being a flat sheet metal hook inserted down through the space 42, having a head 117 which is twisted and then hammered down on top of the top chord as shown in phantom in FIG. 20.

Figure 21:
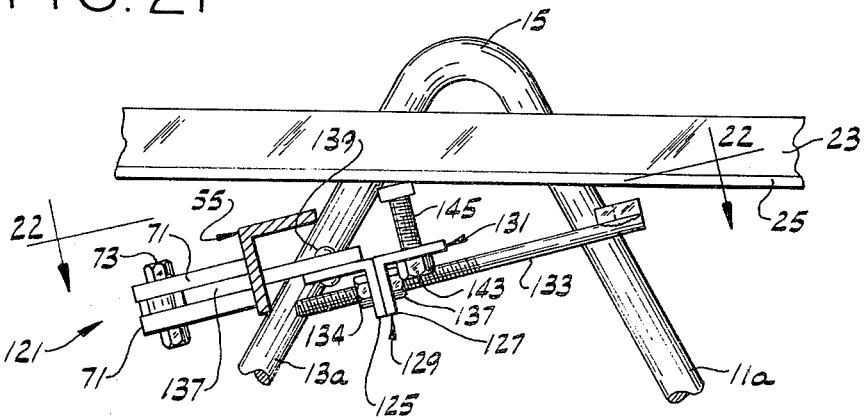
FIG. 21 is a view similar to FIG. 3 showing a special clamp particularly for use with joists having inverted top chord angle bars.
Figure 22:
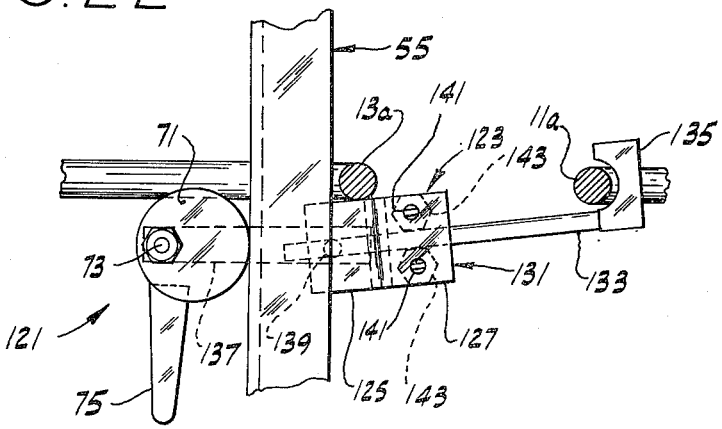
FIG. 22 is a section generally on line 22—22 of FIG. 21.

FIGS. 21 and 22 illustrate another clamp which is particularly useful for holding supports 55 for forms 57 in conjunction with composite steel joists such as shown in U.S. Pat. No. 3,362,121, having inverted top chord angles. With regard to such joists, the horizontal legs 25 of the top chord angles are at the bottom of the vertical legs 23 of these angles instead of at the top, and it is necessary to have the supports 55 spaced down below these horizontal bottom legs 25 of the top chord angles for insertion of the forms 57 under them. The clamp 121 shown in FIGS. 21 and 22 comprises a T-shaped body generally designated 123 made of two angles 125 and 127 arranged back to back so that the body has a stem 129 and a T-head 131. A screw 133 is adjustably threaded in a pair of nuts 134 and 137 on opposite sides of the stem 129 and extends through a hole in the stem. The screw has a hook 135 at its outer end for hooking onto a web member 11a of a joist. An arm 137 pivoted at 139 on the head 131 extends through an opening in the form support 55 and has the disks 71 mounted for rotation thereon at its outer end as indicated at 73. The head 131 has a pair of openings such as indicated at 141 and a pair of nuts 143 welded to its underside at the openings. A capscrew 145 extends down through one of the openings and is adjustably threaded in the respective nut 143. It may be removed and threaded in the other nut. The head of the capscrew 145 is engageable with the bottom face of a bottom leg 25 of the inverted top chord angle as shown in FIG. 21 for spacing the support 55 down from said bottom leg to provide space for accommodating a form 57 between the support and said bottom leg.

Figure 23:
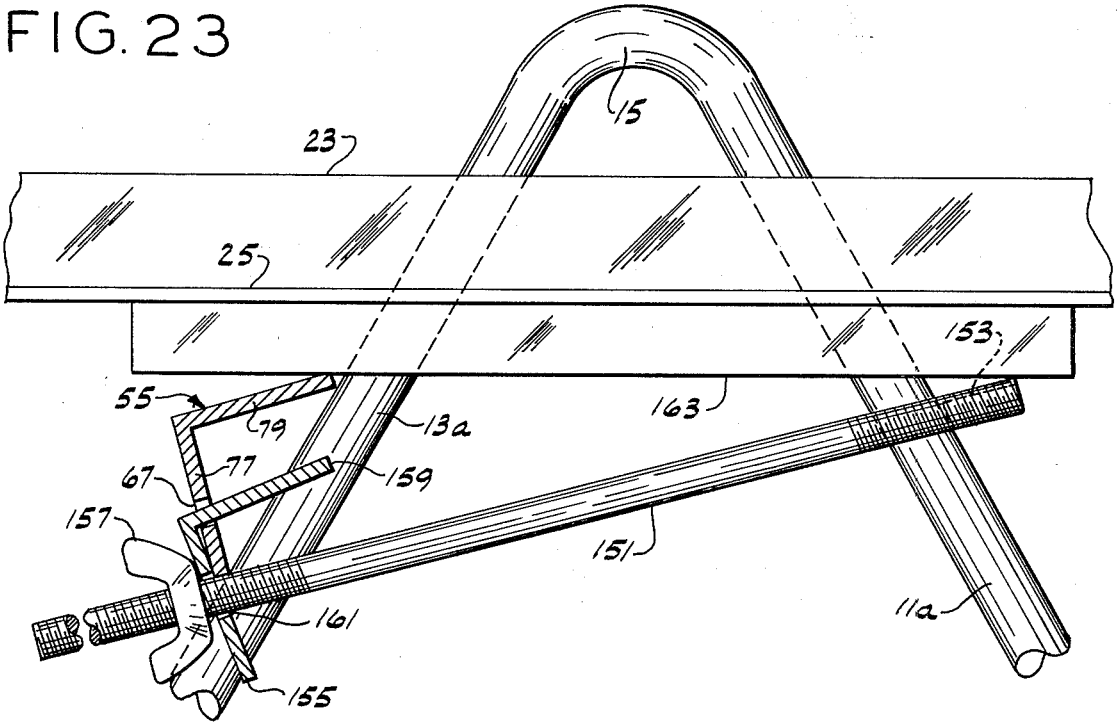
FIGS. 23–25 are views showing a clamp of this invention.
Figure 24:
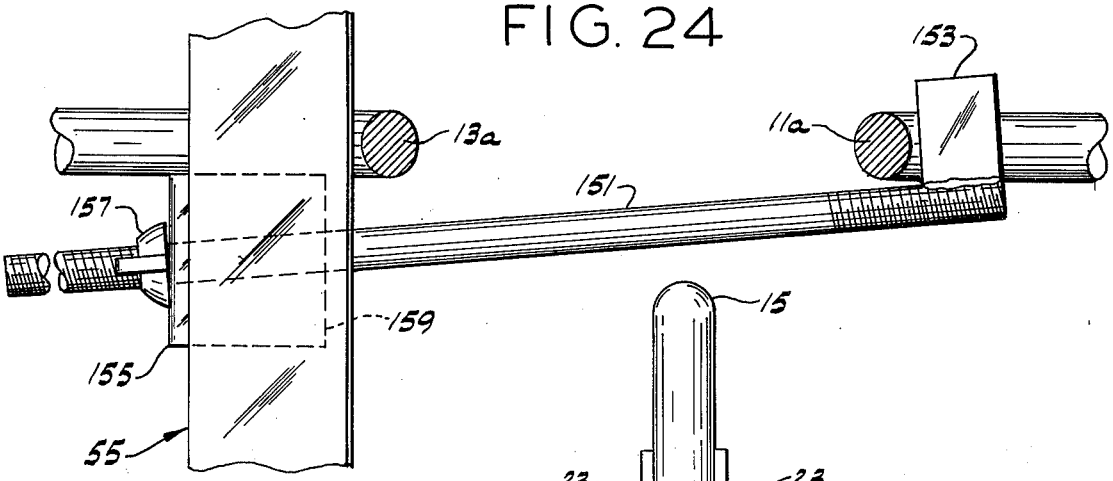
Figure 25:
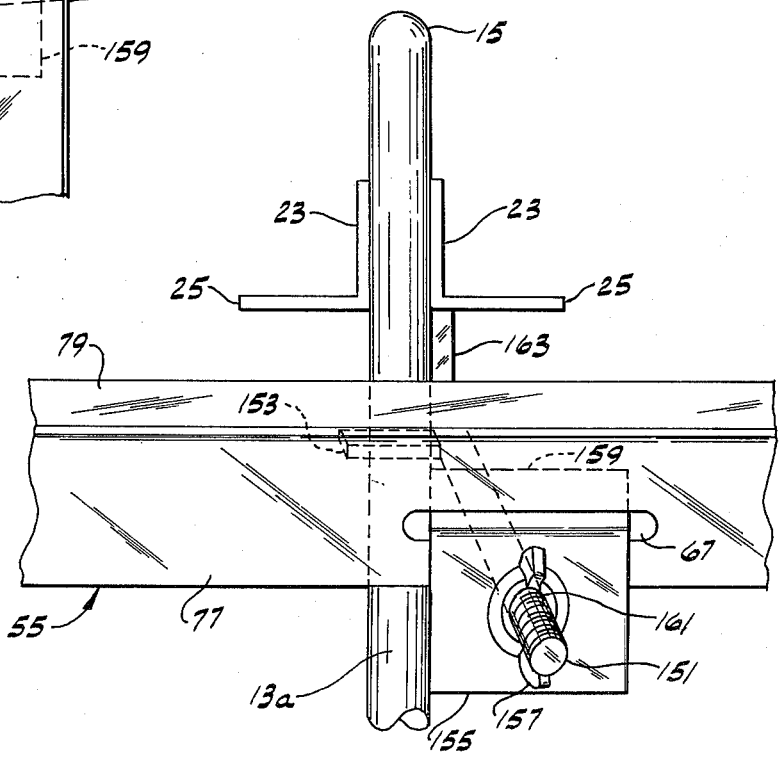

FIGS. 23–25 illustrate an ultimate version of the clamp of this invention, comprising a screw 151 having hooking means 153 (corresponding to 135) at one end, a member 155 engageable with the form support 55 for pushing it up the inclined web member 13*a*, and a wing nut 157 threaded on the screw engageable with the outside of member 155. Member 155 has a part 159 engageable in one of the openings 67 in the form support 55 and a hole 161 loosely receiving the screw 151 spaced from part 159 a distance positioning the screw to extend underneath the form support. As illustrated, member 155 is conveniently formed as a piece of angle iron, one leg of which constitutes part 159 engageable in an opening 67 in the form support, and the other leg of which extends down on the outside of the form support and has the screw hole 161 therein. The clamp shown in FIGS. 23–25 has the advantage that it is readily completely removable from and readily attachable to a form support.

Inverted top chord angles are shown in FIGS. 23–25, and FIGS. 23 and 25 illustrate the use of a spacer 163 to space the form support 55 down below the horizontal bottom legs 25 of these angles for insertion of the forms underneath them. The spacer 163 is very simply a short length of metal strip of a width corresponding to the thickness of a form 57 welded to the web diagonals 11*a* and 13*a* at the bottom of one of the top chord angles at the top chord panel point where the clamp is applied.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A clamp for use in erecting formwork for pouring a slab in place on steel joists, each joist being in the form of a truss having a web, a top chord and a bottom chord, the web being formed of metal bar stock and comprising inclined tension and compression members triangulating the space between the top and bottom chords, the top chord comprising a pair of metal bars having their vertical legs welded to opposite sides of the web, said clamp being adapted for the removable mounting of form supports extending transversely of the joists through the webs of the joists underneath the top chords of the joists, said form supports having openings for the clamp, said clamp having means at one end thereof for hooking onto an inclined web member of a joists and means at its other end for pushing the form support up another inclined web member of the joist, and comprising a screw having said hooking means at one end thereof, a member engageable with the form support for pushing it up said other inclined web member having a part engageable in one of said openings in the form support and a hole receiving the screw spaced from said part a distance for positioning the screw to extend underneath the form support, and a nut threaded on the screw engageable with the outside of said member.

2. A clamp as set forth in claim 1 wherein said member comprises a piece of angle iron one leg of which is engageable in one of the openings in the form support and the other leg of which has said screw hole therein.

* * * * *